US011719045B2

(12) United States Patent
Moscaritolo

(10) Patent No.: US 11,719,045 B2
(45) Date of Patent: Aug. 8, 2023

(54) DRILL DRIVE DEVICE FOR AN EARTH DRILLING APPARATUS

(71) Applicant: EURODRILL GmbH, Drolshagen (DE)

(72) Inventor: Tobias Moscaritolo, Meinerzhagen (DE)

(73) Assignee: EURODRILL GmbH, Drolshagen (DE)

( * ) Notice: Subject to any disclaimer, the term of this patent is extended or adjusted under 35 U.S.C. 154(b) by 6 days.

(21) Appl. No.: 17/544,519

(22) Filed: Dec. 7, 2021

(65) Prior Publication Data

US 2022/0178204 A1 Jun. 9, 2022

(30) Foreign Application Priority Data

Dec. 7, 2020 (EP) ..... 20212287

(51) Int. Cl.
*E21B 4/06* (2006.01)
*E21B 4/00* (2006.01)
*E21B 6/02* (2006.01)

(52) U.S. Cl.
CPC ..... *E21B 4/06* (2013.01); *E21B 4/003* (2013.01); *E21B 6/02* (2013.01)

(58) Field of Classification Search
CPC ..... E21B 4/06; E21B 4/003; E21B 6/02
See application file for complete search history.

(56) References Cited

U.S. PATENT DOCUMENTS 2,226,559 A * 12/1940 Groom ..... B25D 11/10 173/205
3,160,217 A * 12/1964 Raihle ..... B25D 11/10 173/205
4,103,747 A * 8/1978 Finney ..... B25D 11/102 173/203
4,171,024 A * 10/1979 Wilson ..... B25D 11/102 173/133
4,582,145 A * 4/1986 Salmi ..... E21B 6/00 173/132
2006/0102364 A1* 5/2006 Yung ..... B25D 16/00 173/205
2008/0006420 A1* 1/2008 Berghauser ..... B25D 17/26 184/5
2013/0220701 A1* 8/2013 Crowley ..... E21B 21/10 175/322

(Continued)

FOREIGN PATENT DOCUMENTS

CN 85 1 00828 A 12/1985
CN 105401878 B 4/2019
EP 3 336 301 A1 6/2018

*Primary Examiner* — Taras P Bemko
(74) *Attorney, Agent, or Firm* — Studebaker & Brackett PC

(57) ABSTRACT

The invention relates to a drill drive device (10) for an earth drilling apparatus with a spindle arrangement which has an inner spindle unit (20) and an outer spindle unit (40) that is supported in an axially displaceable manner on the inner spindle unit (20) and floating between two spring means (50, 60). According to the invention provision is made in that a first front spring means (50) which is arranged on a drilling tool side comprises a combination of at least a compression coil spring and a first disk spring arrangement (54) and in that a second rear spring means (60) which faces away from the drilling tool side has a second disk spring arrangement (64).

11 Claims, 3 Drawing Sheets

(56) References Cited

U.S. PATENT DOCUMENTS

Figure 1:
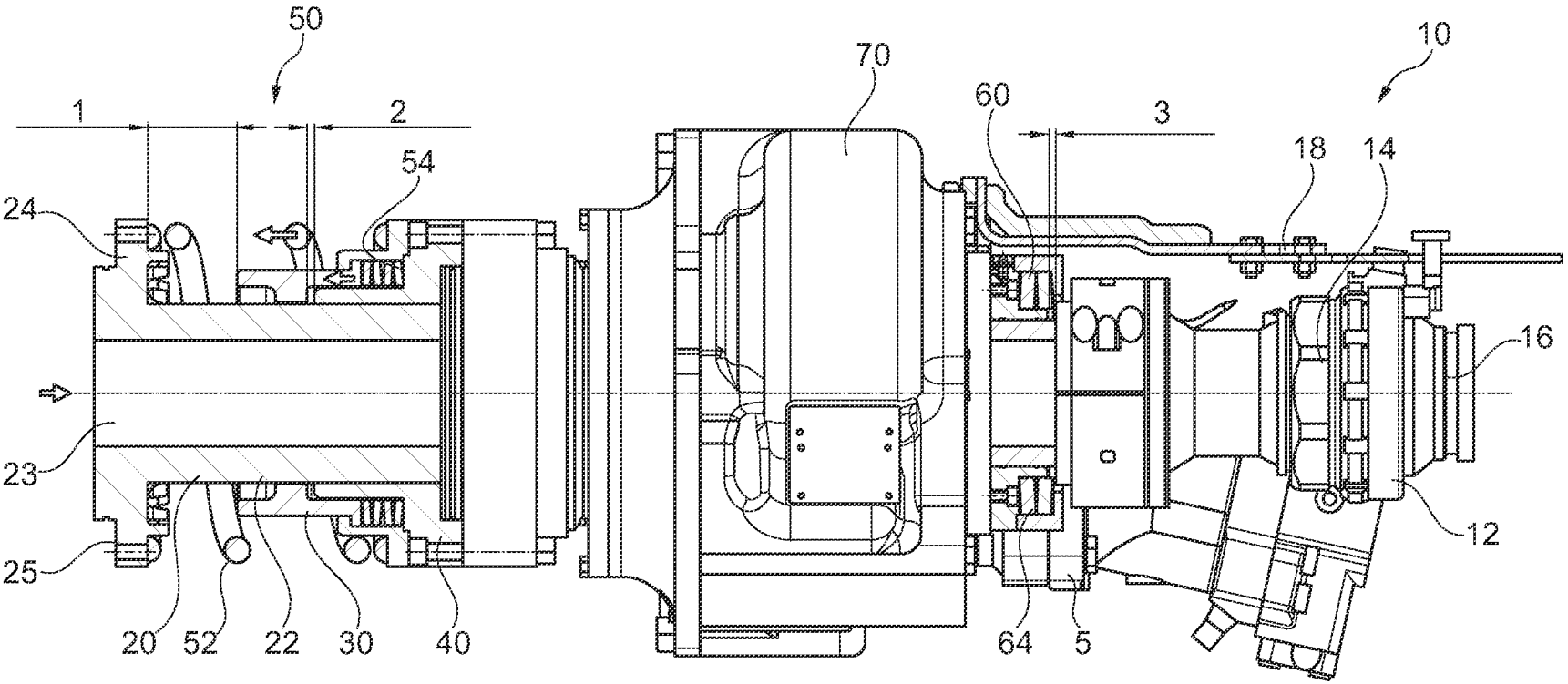

| | | | | |
|---|---|---|---|---|
| 2014/0034387 | A1 | 2/2014 | Ukonjarvi et al. | |
| 2014/0238712 | A1* | 8/2014 | Pikowski ..... | E21B 6/02<br>173/1 |

* cited by examiner

DRILL DRIVE DEVICE FOR AN EARTH DRILLING APPARATUS

The invention relates to a drill drive device for an earth drilling apparatus with a spindle arrangement which has an inner spindle unit and an outer spindle unit that is supported in an axially displaceable manner on the inner spindle unit and floating between two spring means, in accordance with the preamble of claim 1.

Such drill drive devices are in particular known from drilling apparatuses for earth and rock drilling, in which a down-the-hole hammer drilling unit is employed as a drilling tool. In a down-the-hole hammer drilling unit one or several axially driven percussion elements are provided which additionally perform a percussive movement during rotational driving of the down-the-hole hammer drilling unit. Such down-the-hole hammer drilling units can in particular be used for producing a borehole in solid rock. A down-the-hole hammer unit can be taken from EP 3 336 301 A1 for example.

It is known that the additional percussive movement executed in a down-the-hole hammer drilling unit leads to an additional load being exerted on the rotary drill drive. To reduce this load it is furthermore known that a drive spindle of the drill drive is supported in a spring-loaded manner in the axial direction to prevent the axial hammer blows from having a direct effect on the bearings of the drill drive.

However, due to such type of support the further operation of the drive spindle is affected. In particular, in drilling operation it is necessary to apply a certain axial pressing force even when a down-the-hole hammer drilling unit is employed. Moreover, provision must also be made for a certain axial play to allow axial screwing in the case of a drill rod consisting of several drill bars with threaded connections.

The invention is based on the object to provide a drill drive device which enables on the one hand an efficient drilling operation and on the other hand good protection of the drill drive when an axially percussive drilling tool is used.

In accordance with the invention the object is achieved by a drill drive device having the features of claim 1. Preferred embodiments of the invention are stated in the dependent claims.

The drill drive device according to the invention is characterized in that a first front spring means which is arranged on a drilling tool side comprises a combination of at least a compression coil spring and a first disk spring arrangement and in that a second rear spring means which faces away from the drilling tool side has a second disk spring arrangement.

A basic idea of the invention resides in the fact that between the outer spindle unit and the inner spindle unit a floating support between two spring pre-tensioning devices is provided. In particular, a first front spring means which faces towards the side with the drilling tool and a second rear spring means which faces away from the drilling tool side each has a disk spring arrangement. As a result of these two disk spring arrangements percussive movements emanating from the drilling tool, especially a down-the-hole hammer unit, can be absorbed and dampened particularly well. Thereby, depending on the type of arrangement a drilling tool can be connected to the inner spindle unit or the outer spindle unit. By preference, the torque is introduced via the outer spindle unit so that due to the absence of support impacts from the inner spindle unit cannot be transmitted or are only transmitted in a strongly dampened way to the outer spindle unit. Conversely, a torque transmission from a drill drive can also initially take place to the inner spindle unit while the drilling tool is connected directly or via a drill rod to the outer spindle unit.

According to a further aspect of the invention on the first front spring means at least one compression coil spring is arranged in addition to the first disk spring arrangement. Thereby, the compression coil spring which preferably is relatively soft enables in particular easy relative displacement between the two spindle units which is advantageous when screwing on drill rod elements with threaded connections for example. All in all, an efficient drilling operation concomitant with a good dampening of blows from the drilling tool to the drill drive can thus be achieved.

A preferred embodiment of the invention resides in the fact that the compression coil spring of the first spring means is retained on the one hand on a radially outward-directed first flange on the external side of the inner spindle unit and on the other hand on a bearing ring which is supported on the outer spindle unit by being axially displaceable and spring-loaded by the disk spring arrangement. Due to the fact that the compression coil spring is supported on the external side of the spindle arrangement good movability along with easy maintenance of the parts is ensured.

The flange on the external side can be designed integrally with the inner spindle unit or it can be fixed thereon.

Another expedient embodiment of the drill drive device according to the invention results from the fact that the second disk spring arrangement of the second rear spring means is retained on the one hand on a radially outward-directed second flange of the inner spindle unit and on the other hand on the outer spindle unit. Thereby, at least one of the radially outward-directed flanges is mounted in a releasable manner. All in all, good installation of the spring arrangement is thus rendered possible.

According to a further development of the invention provision is made in that a torque transmission means, in particular an axial splined shaft toothing, is arranged. The torque transmission means is designed to transmit a torque from a drive wheel of a drill drive to the spindle arrangement. Thereby, the torque transmission means can be designed on the inner spindle unit or the outer spindle unit. By preference, the torque transmission means is arranged between the front spring means and the rear spring means. In this way, an excessive load of a drill drive caused by axial blows during drilling operation is counteracted.

Basically, the disk spring arrangements can be of any chosen design. According to a further development of the invention an embodiment requiring especially low maintenance results from the fact that the first disk spring arrangement and/or the second disk spring arrangement are received in a receiving recess. Thereby, the receiving recess can in particular be designed on one of the flanges. The receiving recess is a ring-shaped receiving groove in particular.

According to a further embodiment variant of the drill drive device according to the invention it is advantageous that on a front side of the inner spindle unit a connecting means for mounting a drill rod element is provided. Thereby, in the connecting means a thread can in particular be provided onto which a matching thread region of a drill rod element is screwed.

For an efficient drilling operation it is especially advantageous that the compression coil spring has a smaller spring constant and a larger spring deflection than those of the first disk spring arrangement. In this way, the compression coil spring can in particular ensure a necessary axial play that is desirable for mounting drill rod elements.

In conjunction with this it is especially advantageous that the spring deflection of the compression coil spring is equal to or larger than a thread length of a drill rod element with a connecting thread to be mounted.

To ensure a defined axial movement between the two spindle units it is expedient, according to a further development of the invention, that on the inner spindle unit a ring-shaped guide slot is formed, into which a sleeve-shaped guide protrusion of the outer spindle unit engages so as to fit. This ensures a guided movement between the two spindle units.

The invention furthermore comprises a drilling apparatus, in particular an earth drilling apparatus with at least one drill drive, wherein by the drill drive an outer spindle unit of a drill drive device according to the invention is driven. Thereby, the drilling apparatus can be a pile drilling apparatus in particular which is employed for producing foundation piles in the ground. For this purpose, any type of drilling tool can be used, such as a drilling auger, a continuous flight auger, a drilling bucket or the like.

According to a further development it is preferred that as drilling tool a down-the-hole hammer unit is mounted on a drill rod which can be driven in a rotating manner by means of the drill drive device. Such a down-the-hole hammer unit is generally known from prior art. This has a base body which usually is of cylindrical shape and at the ground-facing underside of which one or several hammer elements are driven in an axially reversible manner. An axial driving of the hammer elements can in particular take place by supplying a pressure fluid, especially pressurized air. For the supply of the pressure fluid as well as a drilling liquid and/or for the discharge of the drilling liquid with drill cuttings the spindle arrangement, and in particular the inner spindle unit, can be of tubular design with an internal hollow space, through which corresponding lines can be guided.

Figure 2:
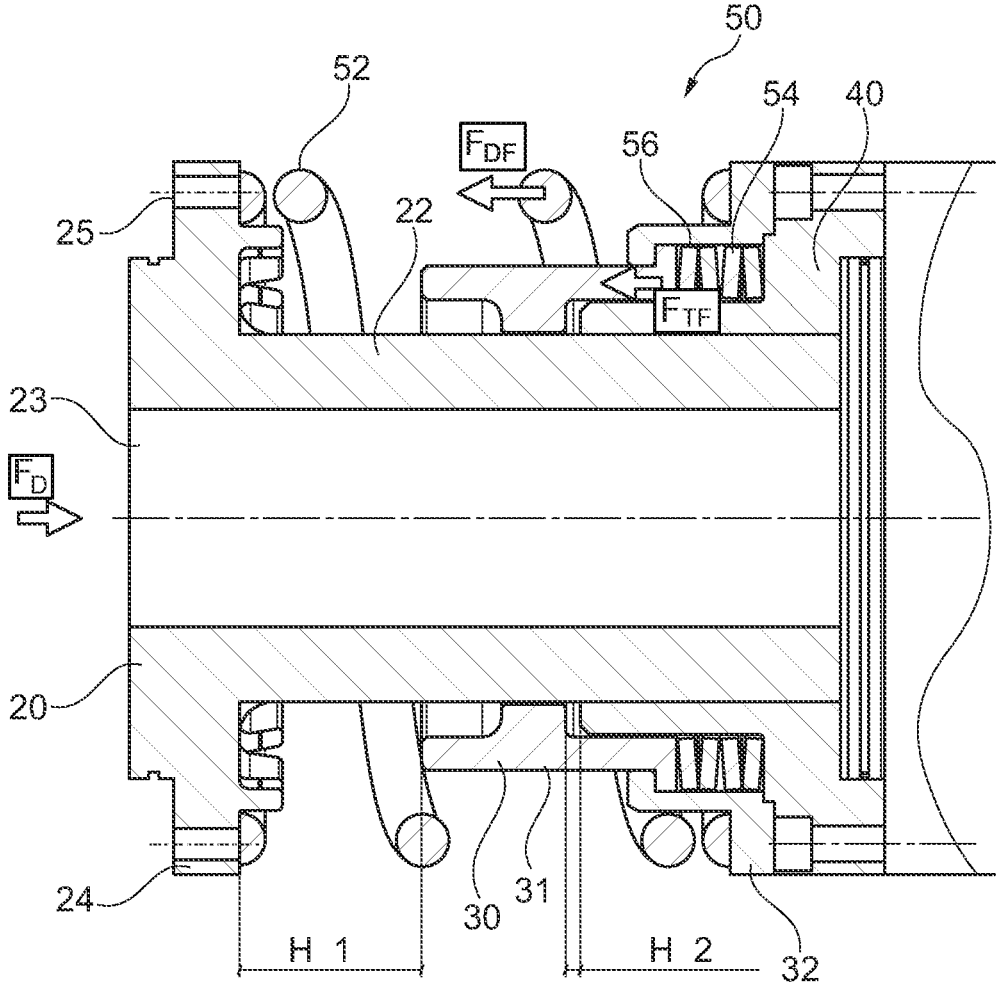
Figure 3:
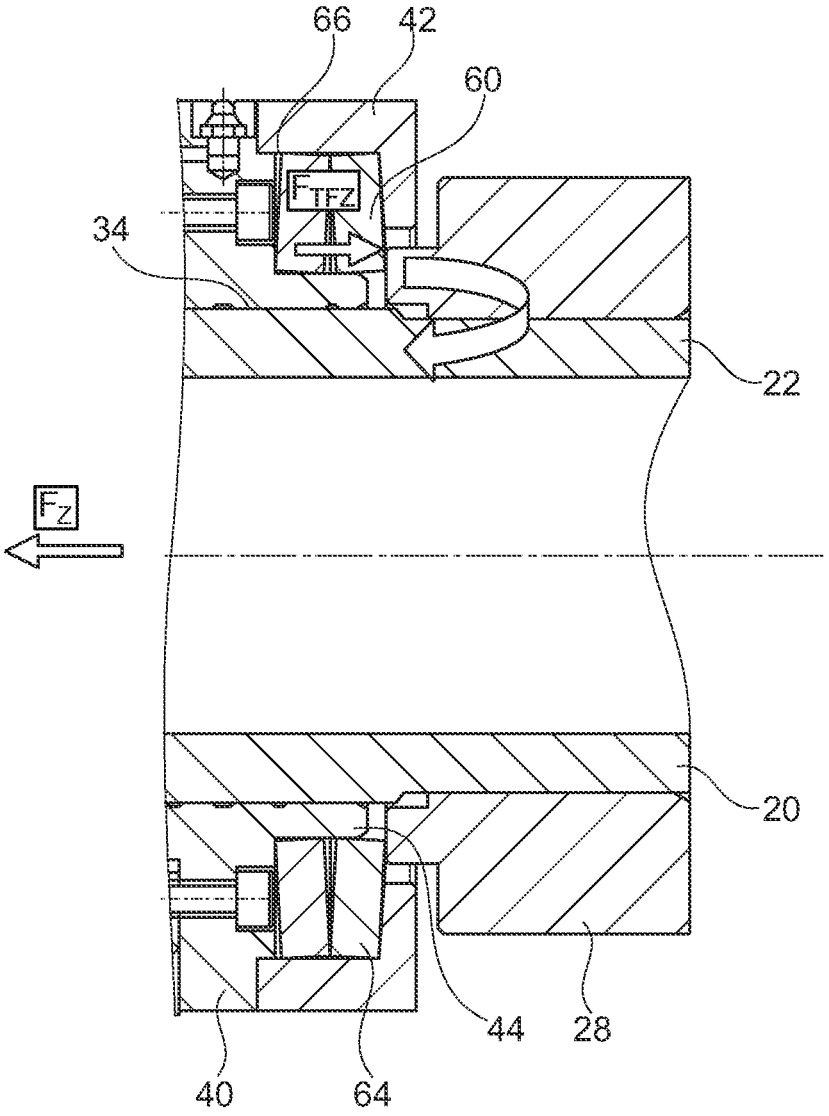

The invention is described further hereinafter by way of a preferred embodiment illustrated schematically in the drawings, wherein show:

FIG. 1 a schematic cross-sectional view of a drill drive device according to the invention;

FIG. 2 an enlarged illustration of the left-hand region of the drill drive device according to FIG. 1; and FIG. 3 an enlarged cross-sectional view of the right-hand region of the drill drive device according to FIG. 1.

A drill drive device 10 according to the invention which is illustrated in FIGS. 1 to 3 is substantially constructed of an inner spindle unit 20 having a tubular base body 22 with an inner duct 23 and a tubular outer spindle unit 40 which is coaxial to the inner spindle unit 20 and surrounds the latter. Via an approximately central torque transmission means 70 a torque is transmitted in a generally known manner via one or several drill drives 5, preferably driven hydraulically, to the outer spindle unit 40 and/or the inner spindle unit 20. The inner spindle unit 20 extends rearwards through the ring-shaped torque transmission means 70 and, at its rear end facing away from a drilling tool, has a rotary feedthrough 12 to transmit at least one fluid from a non-depicted drilling apparatus to the inner duct 23 of the tubular inner spindle unit 20.

The rotary feedthrough 12 substantially has two main components, namely a rotor 14, which is connected in a torque-proof manner to the inner spindle unit 20 and, facing away therefrom to the rear, a stator 16 which is retained via a torque support 18 on a housing of the torque transmission means 70. The rotor 14 rotates relative to the stationary stator 16, on which a fluid line e.g. for transmitting a flushing or drilling suspension can be attached. The outer spindle unit 40 rotates with the inner spindle unit 20 which is supported in an axially displaceable manner relative to the outer spindle unit 40.

On a front side of the inner spindle unit 20 directed towards a borehole a radially outward-directed first flange 24 is arranged on which a drilling tool can be releasably fixed by means of a connecting means 25 in a direct or indirect manner via mounted drill rod elements. The drilling tool can in particular be a down-the-hole hammer drilling unit that has one or several axially driven percussion elements.

To dampen percussive pulses from a down-the-hole hammer drilling unit onto the torque transmission means 70 the drill drive device 10 is provided with a first spring means 50 and a second spring means 60 which will be explained in greater detail hereinafter with reference to FIGS. 2 and 3.

The first spring means 50 has two spring components, namely a compression coil spring 52 and a first disk spring arrangement 54. The compression coil spring 52 which is coaxial to the drilling axis is retained thereby towards the front on the first flange 24 on the tubular base body 22 of the inner spindle unit 20 and on the other hand on a bearing ring 30.

The bearing ring 30 can have a first ring 31 and a second ring 32. Here, the first ring 31 is displaceably supported on the external side of the inner spindle unit 20 and, by means of the coaxial first disk spring arrangement 54, is retained in a spring-loaded manner with respect to the outer spindle unit 40, wherein a first pre-tensioning force FTF is exerted by the first disk spring arrangement 54 onto the first ring 31 and thus the bearing ring 30. Via a radially projecting stop the first ring 31 is connected to the second ring 32, on a stair-like step of which the other end of the compression coil spring 52 is retained, wherein via the compression coil spring 52 a pre-tensioning force FDF is exerted onto the first flange 24 and thus onto the inner spindle unit 20.

The compression coil spring 52 enables a stroke H1 which is considerably larger than a stroke H2 of the first disk spring arrangement 54. Here, by preference, the compression coil spring 52 is provided with a smaller spring constant than the first disk spring arrangement 54. The stroke H1 can in particular be designed to compensate the necessary thread distance or screwing distance when screwing on an additional drill rod element. The stroke H2 of the first disk spring arrangement 54 preferably serves to dampen the axial blows that can be exerted by the drilling tool.

According to FIG. 3 the coaxial second spring means 60 solely has a second disk spring arrangement 64 which is retained on the one hand on a shoulder of the outer spindle unit 40 and on the other hand on a second flange 28 which is releasably fixed, more particularly screwed onto the external side of the tubular base body 22 of the inner spindle unit 20. By means of a cover ring 42 on the outer spindle unit 40 a second receiving recess 66 is formed, in which the disk springs of the second disk spring arrangement 60 are arranged in a protected manner. Via the second disk spring arrangement 60 a pre-tensioning force $F_{TFZ}$ can be transmitted from the outer spindle unit 40 to the inner spindle unit 20 which can also serve to dampen axial forces of a down-the-hole hammer drilling unit. The cover ring 42 keeps the disk springs 60 under pre-tension when the inner spindle unit 20 is displaced axially towards the right side.

To ensure guidance a ring-shaped guide slot 34 can be arranged on the external side of the tubular base body 22, into which guide slot a corresponding guide protrusion 44 of the outer spindle unit 40 engages.

The invention claimed is:

1. A drill drive device for an earth drilling apparatus with a spindle arrangement which has an inner spindle unit and an outer spindle unit that is supported in an axially displaceable manner on the inner spindle unit and floating between two spring means, wherein a first front spring means which is arranged on a drilling tool side comprises a combination of at least a compression coil spring and a first disk spring arrangement and a second rear spring means which faces away from the drilling tool side has a second disk spring arrangement.

2. The drill drive device according to claim 1, wherein the compression coil spring of the first spring means is retained on the one hand on a radially outward-directed first flange on the external side of the inner spindle unit and on the other hand on a bearing ring which is supported on the outer spindle unit by being axially displaceable and spring-loaded by the first disk spring arrangement.

3. The drill drive device according to claim 1, wherein the second disk spring arrangement of the second rear spring means is retained on the one hand on a radially outward-directed second flange of the inner spindle unit and on the other hand on the outer spindle unit.

4. The drill drive device according to claim 1, wherein a torque transmission means, in particular an axial splined shaft toothing, is arranged.

5. The drill drive device according to claim 1, wherein the first disk spring arrangement and/or the second disk spring arrangement are received in a receiving recess.

6. The drill drive device according to claim 1, wherein on a front side of the inner spindle unit a connecting means for mounting a drill rod element is provided.

7. The drill drive device according to claim 1, wherein the compression coil spring has a smaller spring constant and a larger spring deflection than those of the first disk spring arrangement.

8. The drill drive device according to claim 7, wherein the spring deflection of the compression coil spring is equal to or larger than a thread length of a drill rod element with a connecting thread to be mounted.

9. The drill drive device according to claim 1, wherein on the inner spindle unit a ring-shaped guide slot is formed, into which a sleeve-shaped guide protrusion of the outer spindle unit engages so as to fit.

10. A drilling apparatus, in particular earth drilling apparatus, with at least one drill drive, wherein by the drill drive the outer spindle unit of the drill drive device according to claim 1 is driven.

11. The drilling apparatus according to claim 10, wherein as a drilling tool a down-the-hole hammer unit is mounted on a drill rod which can be driven in a rotating manner by means of the drill drive device.

* * * * *